United States Patent [19]

Scivoletto

[11] Patent Number: 4,759,135

[45] Date of Patent: Jul. 26, 1988

[54] AIR DIFFUSER AND HAIR LIFTER ATTACHMENT FOR BLOW DRYER

[76] Inventor: Joseph C. Scivoletto, 8651 N.W. 27th St., Coral Springs, Fla. 33065

[21] Appl. No.: 35,737

[22] Filed: Apr. 8, 1987

Related U.S. Application Data

[63] Continuation-in-part of Ser. No. 906,171, Sep. 11, 1986.

[51] Int. Cl.[4] ..... A45D 20/52

[52] U.S. Cl. ..... 34/97; 34/101; 132/9; 132/112

[58] Field of Search ..... 34/97, 101, 3; 132/7, 132/9, 112

[56] References Cited

U.S. PATENT DOCUMENTS

| | | | |
|---|---|---|---|
| 3,180,342 | 4/1965 | Dietsche | 132/120 |
| 3,730,190 | 5/1973 | Ford | 132/11 |
| 4,295,283 | 10/1981 | Tomaro | 34/97 |

*Primary Examiner*—Larry I. Schwartz
*Attorney, Agent, or Firm*—Harry W. Barron

[57] ABSTRACT

An attachment for a hair dryer performs the function of providing a lower velocity diffused air flow with apparatus to separate and lift the hair and allow the entire hair strand, from root to end, to be dried at the same time. The attachment includes a base member shaped to expand and turn a column of air from a conventional blow dryer by, for instance, 45 degrees. A face plate holds a diffuser pad in position. Extending from the face plate away from the base are a plurality of hair lifters, each of which lift a small amount of hair, so as to permit the entire hair, from root to end, to receive air and be dried at the same time. The face plate includes a plurality of holes therethrough to permit air flow and each hair lifter includes a post extending upward from the edge of the hole and an extension from the top of the post into the area above the corresponding hole. This structure allows the face plate to be fabricated by injection molding. Techniques to even the air flow through the holes of the face plate are also described. In use, the attachment is inserted into the hair, rotated to allow the lifters to separate and catch the hair and then removed to lift the hair while drying. While removing the attachment, it may be redirected towards or away from the face or it may be moved outward along a spiral path.

23 Claims, 4 Drawing Sheets

AIR DIFFUSER AND HAIR LIFTER ATTACHMENT FOR BLOW DRYER

This invention is a continuation-in-part of U.S. patent application Ser. No. 06/906,171, Filed, Sept. 11, 1986 and entitled "Hair Dryer Attachment".

This invention relates to an attachment for a blow dryer and more particularly to such an attachment which includes hair lifters and an air diffuser and which may be utilized to gently dry the hair while lifting the hair to provide a straight, wavy or curly style.

In the past, portable hand held hair dryers have become very popular, both as tools of the professional hair stylist and as tools of individuals desiring to dry and/or style their own hair. Such dryers generally provide a column of hot air at a circular outlet thereof. Internal to the dryer is an air moving means, such as an air pump, and a heater element. Typically, the hair dryer includes user operated switches to control both the speed and the heat of the air exiting the outlet of the dryer.

In addition, many attachments have been designed for hair dryers. One popular type of attachment is the diffuser, in which the attachment is shaped to expand from approximately the size of the dryer outlet to a size several times the size of the outlet. The diffuser typically includes a diffuser pad and a substantially open face plate for holding the pad at the outlet of the diffuser attachment. The combination of the diffuser pad and face plate provide a much larger and more gentle stream of air directed at the hair. Such a diffuser is used, for example, by people with curly hair, whether natural or as a result of a permanent set, to prevent the hair from being messed or straightened by the high velocity air directly from the dryer.

One problem with present day diffusers is that each is a relatively long device and is attached to a relatively long dryer. This results in a person having to hold a handle of the dryer at a long distance from the hair. This makes reaching certain areas of the hair, such as the back or top, difficult for the person desiring to dry their own hair. The reason that diffusers are generally straight is to maintain an even air flow from the air outlet thereof.

In copending application Ser. No. 06/906,171, invented and owned by the inventor hereof, there is disclosed a blow dryer attachment hair styler utilizing the concept of hair lifters added to the tips of picks and the concept of deflecting air to the pick and hair lifter combination. This lifters of the styler attachment lifts the hair such that the roots are dried by the deflected air before the ends of the hair are dried, resulting in the dried hair having more body. The concept of hair lifters of the copending hair styler invention is also applicable to a diffuser attachment in that, in most situations, it is desired to lift the hair as it is being dried by the diffused air. However, the manner of attaching the lifters to a diffuser face plate and still allowing injection molded parts to be produced is a problem which must be solved.

One popular hair style is known as "scrunch" styling. Such a style is presently done by a hair stylist using a hand to catch the hot air from a dryer and then squeezing a portion of the customer's hair as a part of the drying process. This technique provides a wide sawtooth appearance for each stand of hair. Typically, the air at the output of the dryer cannot be directly used in scrunch styling due to the high velocity of the air, so the hand is used as a diffuser. This technique takes a long time to accomplish and is uncomfortable for the stylist, since the hot air can burn the hand. Further, this styling technique is very difficult to do by the user on himself or herself. The prior art diffuser cannot be used for scrunch drying because the hair is dried from the outside towards the roots, not together. However, the prior art diffuser concept does present the desirable attribute of slow flowing air and the hair lifter concept of the prior copending styler presents the desirable attribute of being able to lift the hair, so the roots and ends of the hair can be dried together. Both of these attributes are necessary for the scrunch style to be obtained by using a single attachment for a hair dryer.

Other types of styles which require a gentle flow of air and lifting or redirecting the hair include the curly style, full bodied straight, or Bob, style, the feathered style and the forward, or pixie, style. In each of these styles, the prior art diffuser is unable to provide the proper look because it cannot lift or redirect the hair during the drying process. The style is only attainable by a professional stylist using both a diffuser for drying the hair in one hand and a comb for lifting or directing the hair in the other hand. A person can not normally perform such styling in this manner on himself or herself.

In accordance with one aspect of this invention, there is provided an air diffuser and hair lifter attachment for a blow dryer comprising a base, including means for attaching one end of said base to the outlet of said blow dryer and for providing, at the other end of said base, an air outlet larger than the air outlet from said dryer and a diffuser pad sized to fit within said air outlet. In addition, the attachment includes means, including a plurality of air openings therein, having one side for holding said diffuser pad across said air outlet and for having a plurality of hair lifters extending from the other side thereof remote from said air outlet.

One preferred embodiment of this invention is hereafter described, with specific reference being made to the following Figures, in which.

Figure 1:
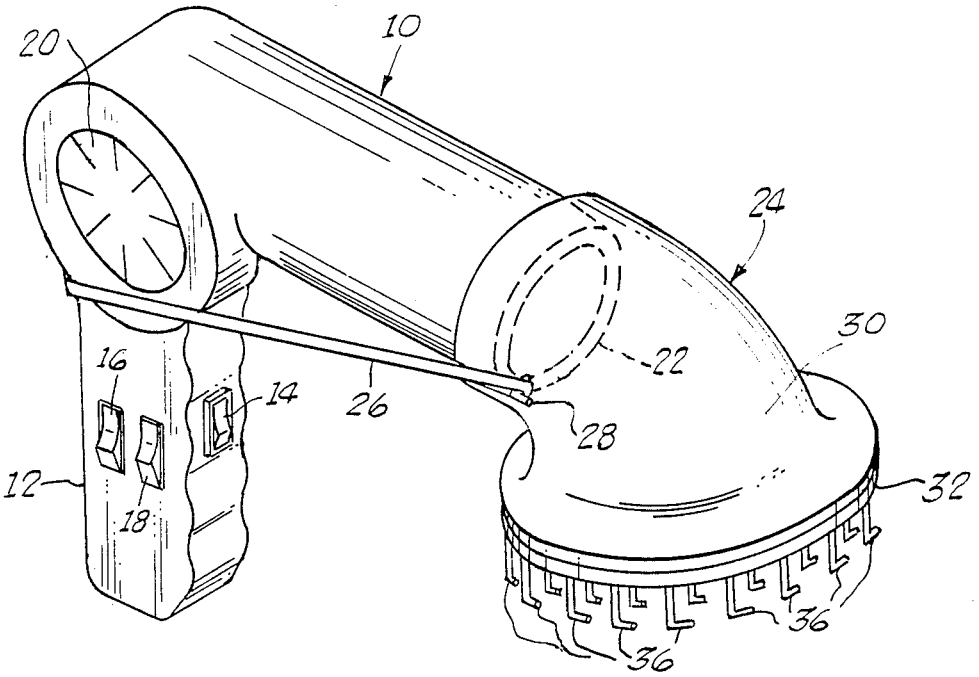
FIG. 1 shows a the improved air diffuser and lifter attachment of the subject invention attached to a conventional blow dryer.
Figure 3:
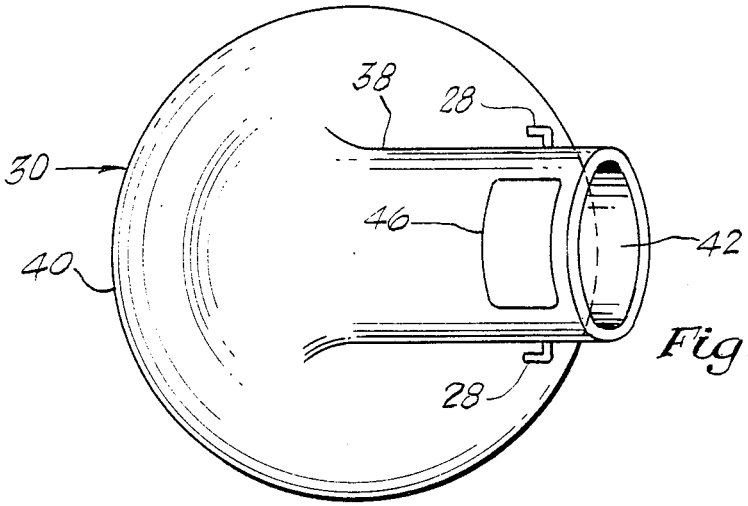
FIG. 3 shows a top view of the base of the improved attachment of the subject invention.
Figure 2:
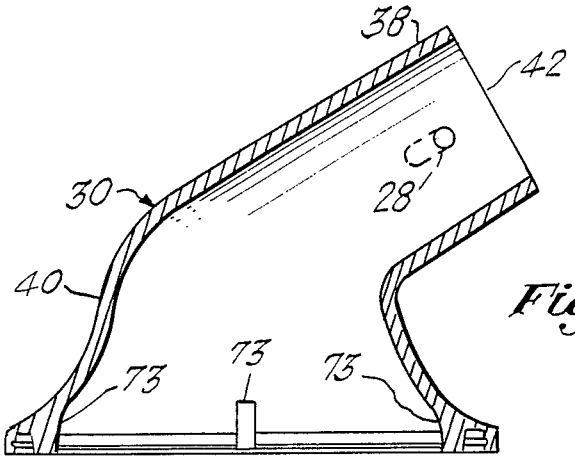
FIG. 2 shows a side view, in cut-away, of the base of the improved attachment of the subject invention.
Figure 4:
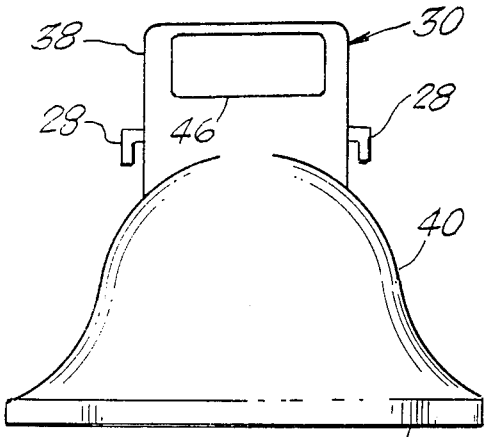
FIG. 4 shows a front view of the base of the improved attachment of the subject invention.
Figure 5:
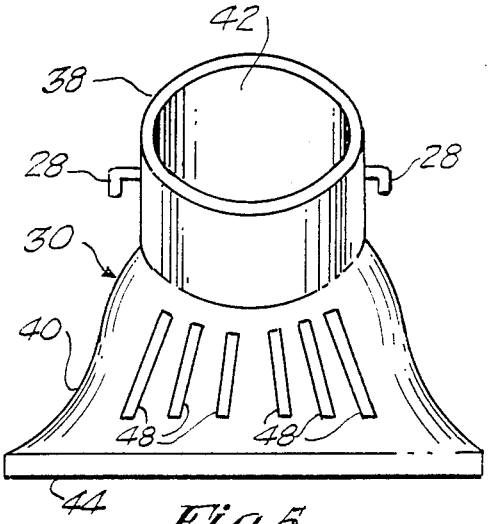
FIG. 5 shows a back view of the base of the improved attachment of the subject invention.

Referring now to FIG. 1, a conventional blow dryer 10 used for drying hair is shown and includes a handle 12 containing three switches 14, 16 and 18. Switch 14 is a finger actuated switch used to turn dryer 10 on and off as desired by the user. Switches 16 and 18 are provided to control the amount of air provided by the fan 20 and the amount of heat provided by the heater elements (not shown) so as to control both the velocity and temperature of the hot air flowing from the outlet 22 of dryer 10.

Figure 8:
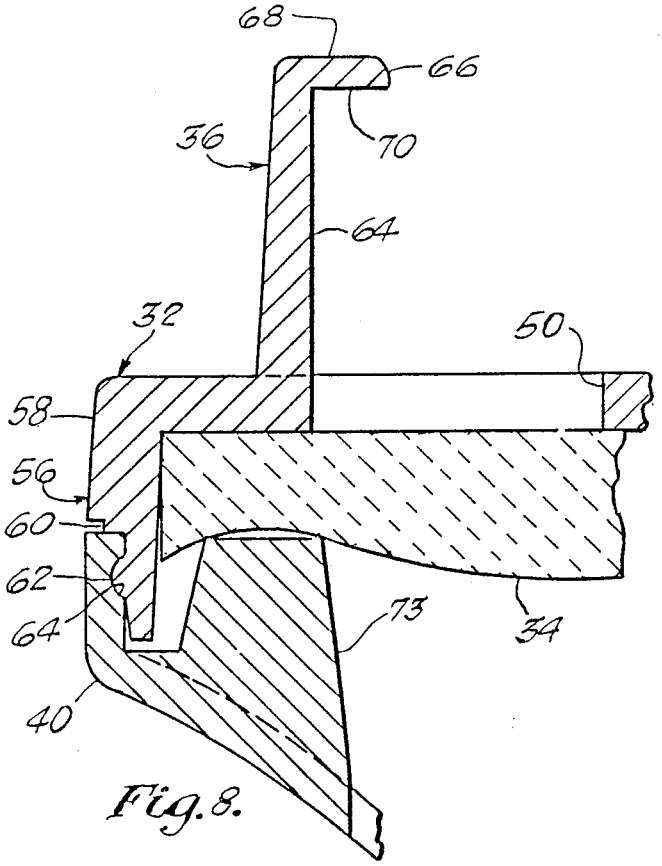
FIG. 8 is a enlarged detailed view, in cut-away, of the structure for holding the face plate and pad against the base and a side view of one of the hair lifters extending from the face plate of the improved attachment of the subject invention.
Figure 9:
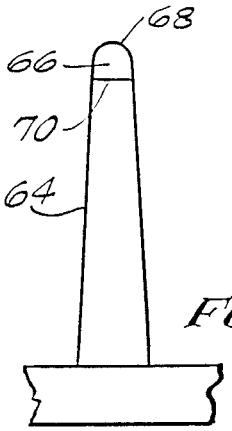
FIG. 9 is an enlarged detailed view, from the front, of a hair lifter.
Figure 10:
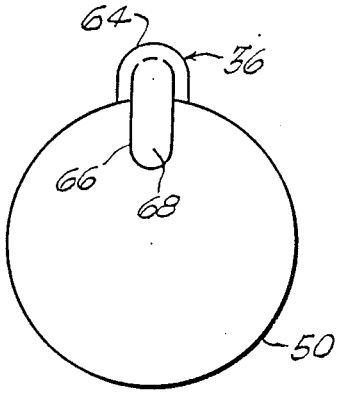
FIG. 10 is an enlarged detailed view, from the top, of a hair lifter.

An air diffuser and hair lifter attachment 24 is also shown in FIG. 1 attached to dryer 10 by an elastic strap 26 attached to two eyelet posts 28, only one of which is shown in FIG. 1, and extending around the back of dryer 10. Attachment 24 includes a base 30 and a face plate 32 attached by a snap lock mechanism to said base 30, as shown in detail in FIG. 8. A conventional diffuser pad 34, also shown in FIG. 8, is inserted on the side of face plate 32 interior to base 30 and held in place by face plate 32 to better diffuse the air. Extending outward from face plate 32 are a plurality of hair lifter members 36 which may be used to lift the hair of the user during the hair drying process, as will be more fully explained hereafter.

Referring now to FIGS. 2 through 5, the base unit 30 is shown. Base unit 30 may be designed to be a single injection molded plastic unit having a neck 38 and an air column expansion chamber 40. Neck 38 has an open end 42 remote from chamber 40 sized to fit over the outlet 22 of most conventional hair dryers, such as dryer 10, either directly, or by using an adaptor (not shown) designed to fit within barrel 38 and over the outlet 22 of a particular dryer 10. Such adaptors are well known and commercially available with other types of attachments for blow dryers, including conventional diffuser attachments. Attached to the outer surface of barrel 38 are the pair of eyelet posts 28 adapted to receive the eyelets on the ends of strap 26. Generally, posts 28 are positioned towards the open end 42 of neck 38 and along a center to center line generally parallel to the bottom 44 of chamber 40. Also, an area 46 is provided on barrel 38 for having information hot stamped on base 30.

The expansion chamber 40 connects barrel 38 with the bottom 44, such that bottom 44 has a diameter several times, for example four, the diameter of the outlet 22 of dryer 10. Chamber 40 is also shaped to place bottom 44 at approximately a forty-five degree angle with respect to the center axis of neck 38. The purpose of such an angle is to permit the user of attachment 24 to work at a position closer to the head, rather than at a straight line and larger distance. This is particularly advantageous to the person drying and styling their own hair. The interior of chamber 40 is designed to maintain a uniform flow of air from bottom 44 despite the change in direction of the flowing air due to the angular shape of base 30.

Air escape slots 48 may be provided on the sides of chamber 40 to allow air at certain high pressure regions to escape and thereby maintain an even flow of air from bottom 44. The positioning and size of slots 48 are selected based on the other techniques, described hereafter, used to assure an even air flow through bottom 44. Also, slots 44 are provided to reduce the pressure of the air flowing through bottom 44 when a face plate 32 is attached thereto, as described hereafter with respect to FIG. 8. Finally slots 44 are desired to reduce any back flow of air back into dryer 10, such as would cause a shorter life expectancy for the heating element in dryer 10. It should be noted that slots 48 may, in fact, be any shape so long as the above described functions are accomplished.

Referring now to FIGS. 6 through 10, faceplate 32 and hair lifters 36 are shown. In its simplest form, faceplate 32 includes a plurality of varying size holes 50, 52 and 54. The largest holes 50 are placed in a matrix configuration on the surface of face plate 50 and small holes 52 are generally centered in the space between large holes 50. Medium size holes 54 are used generally around the circumference of face plate 38 to fill in spaces too small for a large hole 50 and too big for a small hole 52. In actual dimensions, the diameter of face plate 32 may be four and seven eighths inches, the diameter of large hole 50 may be one half of an inch, the diameter of small holes 52 may be one eighth of an inch and the diameter of medium size holes 54 may be thre eights of an inch. The large holes 50 may be spaced apart at six tenths of an inch center to center matrix spacing from the center of face plate 32.

Extending from the circumference of face plate 32 in a direction adapted to fit into the bottom 44 of chamber 40 is a snap lock extension 56. Extension 56 is best seen in FIG. 8 and includes an outer face 58 and a recessed portion 60 adapted to fit into the bottom 44 of chamber 40. Recess portion 60 includes a convex member 62 adapted to be snapped into a locked mating with a corresponding concave part 64 on the inner wall of chamber 40. With this mechanism, face plate 32 may be coupled to the bottom 44 of chamber 40.

Associated with each large hole 50 is one of the hair lifters 36. Each hair lifter 36 includes a post 64 and an extension 66. Post 64 is narrower at its top than at its bottom and one side of the bottom of post 64 is positioned adjacent to one of the large holes 50 in face plate 32. The side of post 64 adjacent to a hole 50 is vertical with respect to the general plane of face plate 32. Extending from the narrower top of post 64 into the space above a hole 50 is extension 66. Extension 66 has a generally rounded or curved side 68 on the side thereof remote from face plate 32 so as not to cause any discomfort to the user of attachment 24. The side 70 of extension 66 facing face plate 32 is flat so as to lift the hair of the user of attachment 24 away from the scalp when extension 66 is inserted into, rotated and thereafter removed from the hair of the user of attachment 24, in the manner hereafter described.

The reason that post 64 is adjacent to the side of a hole 50, that the edge of post 64 is adjacent to the hole 50 and that the extension 66 extends over the hole 50 is to allow the entire face plate 32 assembly to be injection molded by a simple molding tool. With the structure positioned and shaped as just described, one side of a mold tool may be used to define the bottom of face plate 32, hole 50, the side of post 64 and the bottom side 70 of extension 66 and the other side of the mold tool may be used to defining the top of face plate 32, the remainder of post 64 not adjacent to hole 50 and the top 68 of extension 66. Thus, a simple two piece tool without any complicated and expensive cams may be used to obtain the rather complex shape for face plate 32.

Figure 6:
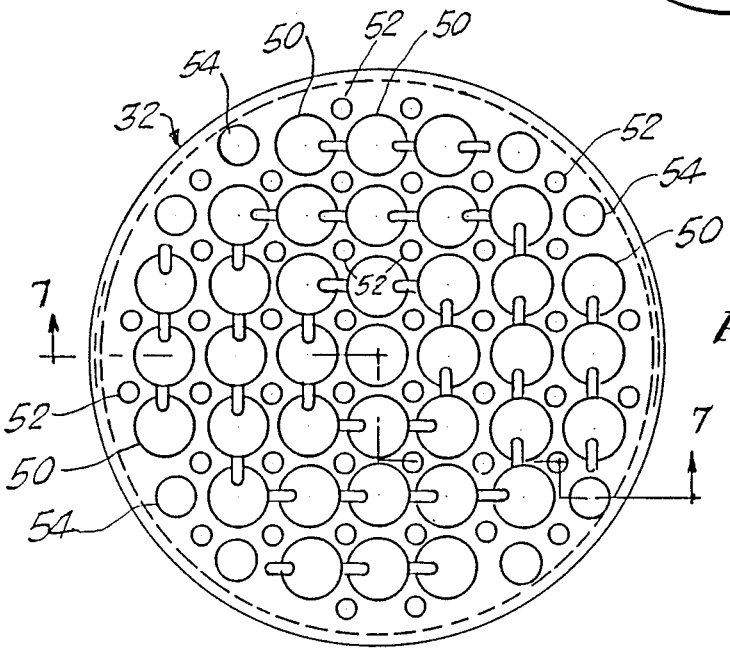
FIG. 6 shows a plan view of the face plate of the subject invention.
Figure 7:
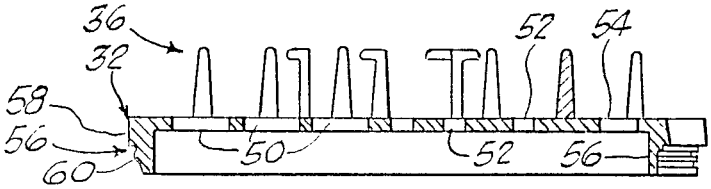
FIG. 7 is a cross sectional view taken across lines 7—7 of FIG. 6.

Referring again to FIGS. 6 and 7, it is seen that the direction of the extensions 66, and the position of posts 64 with respect to the various holes 50 varies. As depicted in FIG. 6, the posts 64 generally found on the right side of the face plate 32 are positioned on the upper side to the holes 50 and the extensions 66 extend in a downward direction over a hole 50. On the bottom side of face plate 32, the posts 64 are on the right side of the holes 50 and the extensions 66 extend in a direction towards the left. Similarly, on the left side of face plate 32, the posts 64 are on the downward facing side of a hole 50 and the extensions 66 extend in an upward direction and on the top side of face plate 32, the posts 64 are on the left side of a hole 50 and the extensions 66 extend in an right direction. Designed in this manner, the extensions 66 of the hair lifters 36 will get under the hair when the attachment 24 is inserted into the hair of the user and rotated in a counterclock wise direction. Then, when attachment 24 is removed from the hair, the hair will be lifted by surface 70 of hair lifters 36.

Referring again to FIGS. 2 and 8, a diffuser pad 34 is positioned on the inside surface of face plate 32 and held in place by four extensions 73 from the bottom inside circumference of chamber 40. Pad 34 may be any conventional plastic mesh air diffuser material which is used to even the air flow through the holes 50, 52 and 54 of face plate 32.

Figure 11:
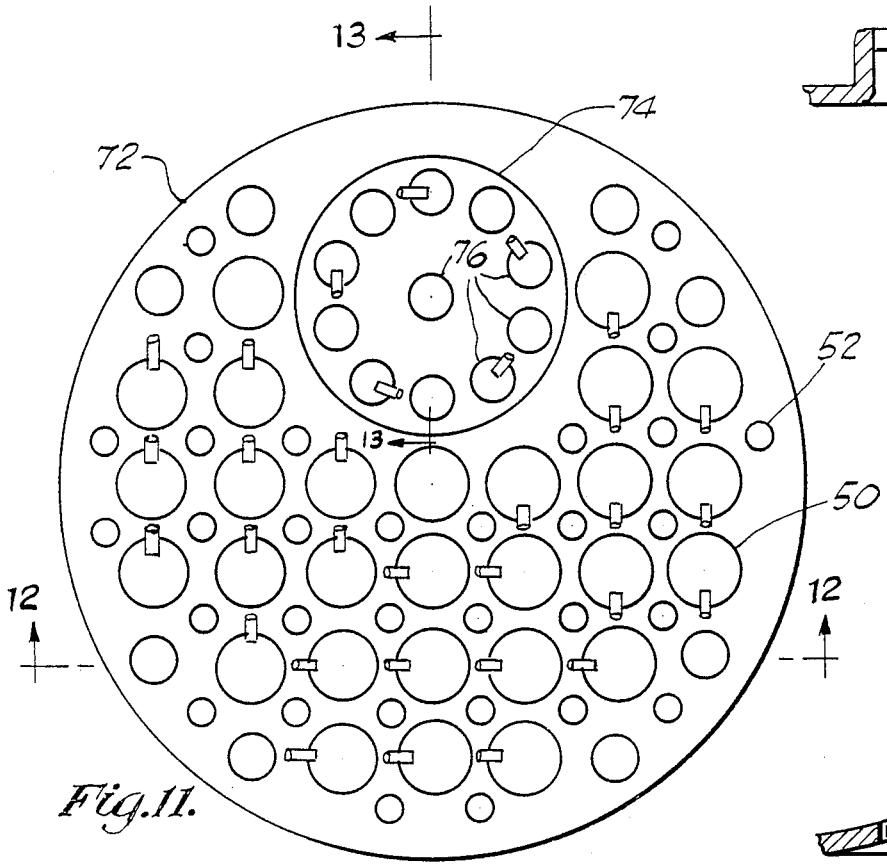
FIG. 11 is an alternate embodiment of a face plate design to permit more equalized air flow.
Figure 13:
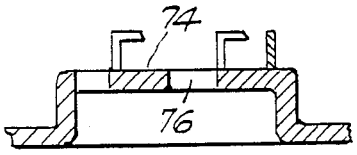
FIG. 13 is a cross sectional view taken across lines 13—13 of FIG. 11.
Figure 12:
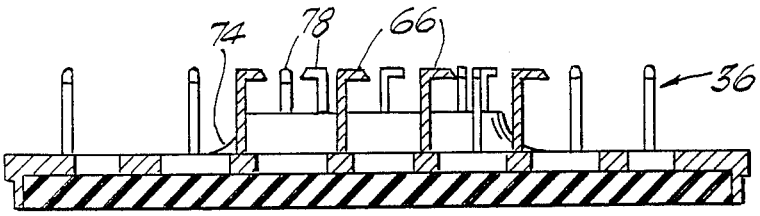
FIG. 12 is a cross sectional view taken across lines 12—12 of FIG. 11.

Referring now to FIGS. 11, 12 and 13, an alternate embodiment of a faceplate 72 is shown. Where like components of face plates 32 and 72 are present, like numerical designations will be used. In faceplate 72, a circular outward extending (from the front of faceplate 72) or recessed (from the back of face plate 72) area 74 is provided in which less surface area is utilized by holes 76. Area 74 is positioned at the location of faceplate 72 where the majority of air from dryer 10 intersects faceplate 72. Due to the lesser amount of area provided by holes 76, compared to the rest of face plate 72, less air from dryer 10 will exit and the remaining air will be diffused within chamber 40 and exit more evenly from the other holes 50, 52 and 54. As seen in FIG. 12, the hair lifters 36 positioned in area 74 have a shorter post 78 to maintain the plane of the extensions 66 constant.

Figure 13A:
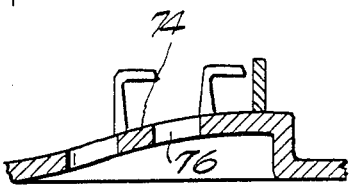
FIG. 13A is an cross sectional view of an alternate embodiment taken across lines 13—13 of FIG. 11.

In faceplate 72, the area 74 may or may not be recessed, as shown in FIGS. 11 through 13. Further, as seen in FIG. 13A, the surface of area 74 may be slanted to provide better air redirection by area 74. In addition, area 76 may be shaped as a teardrop rather than a circle and may be curved in the direction generally above the main planar surface of face plate 72. Also, one may merely size the holes differently throughout face plate 72 to accommodate different pressures gradients found as a result of turning the direction of air flow.

Figure 14:
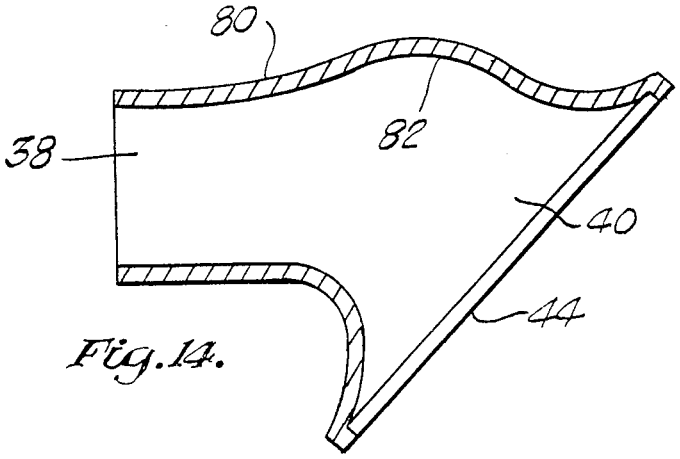
FIG. 14 is an alternate embodiment of the base member designed to permit more equalized air flow.

Referring to FIG. 14, an alternate embodiment of the base 80 is shown in which the air from dryer 10 is more evenly directed by providing a more pronounced dome 82 within the chamber 40. Dome 82 will be positioned to redirect the upper half of the air column flowing from dryer 10 into neck 38 in a more downward, as viewed in FIG. 14, towards the lower part of bottom opening 44 while the lower half of the column of air is directed without interference towards the upper part, as seen in FIG. 14, of bottom opening 44. It should be noted that any combination of the alternate or preferred embodiments, including selective placement of the slots 48, may be used to obtain the necessary amount of evenness of air flow.

As previously mentioned, one manner of using attachment 24 is to insert it, in a direction generally perpendicular to the planar surface of faceplate 32, into the hair of the user. Then, attachment 24 is rotated slightly about an axis perpendicular to the scalp, or to the plane of faceplate 32, so that the lifters 36 separate and catch the hair. Then, attachment 24 is remove from the hair in one of the manners described hereafter, depending on the style desired. With the steps of inserting and rotating, the hair is separated and caught by the lifters 36 and with the step of removing, the hair is lifted, whereby the roots are dried at the same time the rest of the hair is dried. This gives the hair a look of fuller volume, since drying the roots in an upward position allows the hair to extend out from, rather than along, the scalp. Such a use of attachment 24 thus give the hair an appearance of having been styled with the appearance of additional volume.

Many different specific styles are attainable depending upon the technique used to lift attachment 24 away from the scalp after the basic steps of inserting and rotating. For example, if one desired a basic straight hair style, attachment 24 is merely lifted slowly in a generally perpendicular direction away from the tangential plane of the scalp. This causes the hair to be dried in a straight manner and the desired style is attained. On the other hand, if one desired a curly style, attachment 24 is moved in circles as it is perpendicularly removed from the scalp, that is, attachment 24 is removed in a spiral manner. The circular outward movement of attachment 24 causes the separated and lifted hair to be dried in a spiral appearance, hence giving the appearance of curly hair.

Other more sophisticated styles can be attained by removing attachment 24 in a direction other than perpendicular to the scalp. For example, to get a feathered look, attachment 24 is removed in a direction generally outward and away from the face, whereas to get a Pixie, or forward look, attachment 24 is removed from the scalp in a direction generally outward and towards the face. In both of these instances, use of attachment 24 provides the desired hair direction look while at the same time providing the desired full volume look. To attain the scrunch style, attachment 24 is rotated in small circles such as would be used for a tight curly look and, at the same time, moved in and out while the hair is being dried. This type of movement of attachment 24 causes each hair strand to be dried with multiple bends, thereby giving the same effect as the stylist having hand squeezed the hair while drying it. Other fashions may also be created using any combination of the above described techniques or by other removing attachment with other movements or in other directions.

What is claimed is:

1. An air diffuser and hair lifter attachment for a blow dryer used to dry the hair of a user, said attachment comprising:

a base, including means for attaching one end of said base to the outlet of said blow dryer and for providing, at the other end of said base, an air outlet larger than the air outlet from said dryer;

means, including a plurality of air openings therein, having one side facing said air outlet; and a plurality of hair lifters extending from the other side of said means for holding, said lifters being shaped to catch hair strands of the user when said attachment is inserted in the hair of the user and to lift the caught hair strands as said attachment is removed from the hair of the user;

wherein each of said hair lifters is associated with only one of said air openings; and wherein the planes of said one end and said other end of said base are skewed with respect to one another and said base is shaped between said one end and said other end thereof to change the direction of the air flow therein between the direction of the air emitted from said dryer to a different direction for the air flowing through said plurality of openings in said means for holding.

2. The invention according to claim 1 wherein one of said base or means for holding equalizes the amount of air flow through each of said air openings of said means for holding.

3. The invention according to claim 2 wherein said means for holding includes air deflector means to equalize the amount of air flow through each of said air openings of said means for holding.

4. The invention according to claim 2 wherein said air openings are of different areas in order to equalize the amount of air flow through each of said air openings of said means for holding.

5. The invention according to claim 2 wherein said base includes at least one additional opening therein, separate and apart from said inlet or one end or said other end, in order to equalize the amount of air flow through each of said air openings of said means for holding.

6. The invention according to claim 5 wherein said additional opening in said base is sized to reduce the backup of air in said dryer.

7. The invention according to claim 2 wherein each of said hair lifters include a post, extending from said means for holding, and an extension, extending in a direction less than 360 degrees from said post, said extension including a hair lifting surface facing said means for holding.

8. The invention according to claim 7 wherein said hair lifting surface extends only over an air opening in said means for holding.

9. The invention according to claim 8 wherein each of said posts extend from the edge of an air opening of said means for holding.

10. An air diffuser and hair lifter attachment for a blow dryer used to dry the hair of a user, said attachment comprising:

a base, including means for attaching one end of said base to the outlet of said blow dryer and for providing, at the other end of said base, an air outlet larger than the air outlet from said dryer;

means, including a plurality of air openings therein, having one side facing said air outlet; and a plurality of hair lifters extending from the other side of said means for holding, said lifters being shaped to catch hair strands of the user when said attachment is inserted in the hair of the user and to lift the caught hair strands as said attachment is removed from the hair of the user; and wherein each of said hair lifters include a post, extending from said means for holding, and an extension, extending in a direction less than 360 degrees from said post, said extension including a hair lifting surface facing said means for holding.

11. The invention according to claim 10 wherein said hair lifting surface extends only over an air opening in said means for holding.

12. The invention according to claim 11 wherein each of said posts extend from the edge of an air opening of said means for holding.

13. The invention according to claim 10 wherein each of said posts extend from the edge of an air opening of said means for holding.

14. An air diffuser and hair lifter attachment for a blow dryer comprising:

a base, including means for attaching one end of said base to the outlet of said blow dryer and for providing, at the other end of said base, an air outlet larger than the air outlet from said dryer;

a diffuser pad sized to fit within said air outlet; and means, including a plurality of air openings therein, having one side for holding said diffuser pad across said air outlet and for having a plurality of hair lifters extending from the other side thereof remote from said air outlet;

wherein each of said hair lifters include a post, extending from said means for holding, and an extension, extending from said post, said extension including a hair lifting surface facing said means for holding;

wherein said hair lifting surface extends over an air opening in said means for holding;

wherein each of said posts extend from the edge of an air opening of said means for holding;

wherein said plurality of hair lifters are positioned to extend in different directions.

15. An air diffuser and hair lifter attachment for a blow dryer comprising:

a base, including means for attaching one end of said base to the outlet of said blow dryer and for providing, at the other end of said base, an air outlet larger than the air outlet from said dryer;

a diffuser pad sized to fit within said air outlet; and means, including a plurality of air openings therein, having one side for holding said diffuser pad across said air outlet and for having a plurality of hair lifters extending from the other side thereof remote from said air outlet;

wherein each of said hair lifters include a post, extending from said means for holding, and an extension, extending from said post, said extension including a hair lifting surface facing said means for holding;

wherein each of said posts extend from the edge of an air opening of said means for holding;

wherein said plurality of hair lifters are positioned to extend in different directions.

16. An air diffuser and hair lifter attachment for a blow dryer comprising:

a base, including means for attaching one end of said base to the outlet of said blow dryer and for providing, at the other end of said base, an air outlet larger than the air outlet from said dryer;

a diffuser pad sized to fit within said air outlet; and means, including a plurality of air openings therein, having one side for holding said diffuser pad across said air outlet and for having a plurality of hair lifters extending from the other side thereof remote from said air outlet;

wherein each of said hair lifters include a post, extending from said means for holding, and an extension, extending from said post, said extension including a hair lifting surface facing said means for holding;

wherein said plurality of hair lifters are positioned to extend in different directions.

17. An air diffuser and hair lifter attachment for a blow dryer used to dry the hair of a user, said attachment comprising:

a base, including means for attaching one end of said base to the outlet of said blow dryer and for providing, at the other end of said base, an air outlet larger than the air outlet from said dryer;

means, including a plurality of air openings therein, having one side facing said air outlet; and a plurality of hair lifters extending from the other side of said means for holding, said lifters being shaped to catch hair strands of the user when said attachment is inserted in the hair of the user and to lift the caught hair strands as said attachment is removed from the hair of the user; and wherein said plurality of hair lifters are positioned to extend in different directions.

18. An air diffuser and hair lifter attachment for a blow dryer comprising:

a base, including means for attaching one end of said base to the outlet of said blow dryer and for providing, at the other end of said base, an air outlet larger than the air outlet from said dryer;

a diffuser pad sized to fit within said air outlet; and means, including a plurality of air openings therein, having one side for holding said diffuser pad across said air outlet and for having a plurality of hair lifters extending from the other side thereof remote from said air outlet;

wherein one of said base or means for holding equalizes the amount of air flow through each of said air openings of said means for holding;

wherein said base includes a dome within said base to equalize the amount of air flow through each of said air openings of said means for holding.

19. An air diffuser and hair lifter attachment for a blow dryer comprising:

a base, including means for attaching one end of said base to the outlet of said blow dryer and for providing, at the other end of said base, an air outlet larger than the air outlet from said dryer;

a diffuser pad sized to fit within said air outlet; and means, including a plurality of air openings therein, having one side for holding said diffuser pad across said air outlet and for having a plurality of hair lifters extending from the other side thereof remote from said air outlet;

wherein one of said base or means for holding equalizes the amount of air flow through each of said air openings of said means for holding;

wherein said base changes the direction of the air flow therein between the direction of the air emitted from said dryer to a different direction for the air flowing through said plurality of openings in said means for holding;

wherein each of said hair lifters include a post, extending from said means for holding, and an extension, extending from said post, said extension including a hair lifting surface facing said means for holding;

wherein said hair lifting surface extends over an air opening in said means for holding;

wherein each of said posts extend from the edge of an air opening of said means for holding;

wherein said plurality of hair lifters are positioned to extend in different directions.

20. In an air diffuser attachment for a blow dryer used to dry the hair of a user, including a base, having a small end for receiving the air outlet of said blow dryer along a first axis and a large end from which the air of said diffuser exits along a second axis, said diffuser further including means, having a plurality of air openings therein, affixed to said large end, the improvement comprising:

said first axis and said second axis being skewed with respect to one another; and said base being shaped between said one end and said other end thereof to change the direction of the air flow therein from parallel to said first axis to parallel to said second axis; and wherein said base includes a dome to equalize the amount of air flow through each of said air openings.

21. In an air diffuser attachment for a blow dryer used to dry the hair of a user, including a base, having a small end for receiving the air outlet of said blow dryer along a first axis and a large end from which the air of said diffuser exits along a second axis, said diffuser further including means, having a plurality of air openings therein, affixed to said large end, the improvement comprising:

said first axis and said second axis being skewed with respect to one another; and said base being shaped between said one end and said other end thereof to change the direction of the air flow therein from parallel to said first axis to parallel to said second axis; and wherein said air openings are of different areas in order to equalize the amount of air flow through each of said air openings.

22. In an air diffuser attachment for a blow dryer used to dry the hair of a user, including a base, having a small end for receiving the air outlet of said blow dryer along a first axis and a large end from which the air of said diffuser exits along a secnd axis, said diffuser further including means, having a plurality of air openings therein, affixed to said large end, the improvement comprising:

said first axis and said second axis being skewed with respect to one another; and said base being shaped between said one end and said other end thereof to change the direction of the air flow therein from parallel to said first axis to parallel to said second axis; and wherein said base includes at least one additional opening therein, separate and apart from one end and said other end, in order to equalize the amount of air flow through each of said air openings.

23. The invention according to claim 22 wherein said additional opening in said base is sized to reduce the backup of air in said dryer.

* * * * *